US006568322B2

(12) United States Patent
Göttling et al.

(10) Patent No.: US 6,568,322 B2
(45) Date of Patent: May 27, 2003

(54) STAND OF PRINTING UNIT

(75) Inventors: Josef Göttling, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/792,352

(22) Filed: Feb. 23, 2001

(65) Prior Publication Data

US 2001/0029854 A1 Oct. 18, 2001

(30) Foreign Application Priority Data

Feb. 23, 2000 (DE) ..... 100 08 220

(51) Int. Cl.[7] ..... B41F 5/00; B41F 5/16; B41F 3/00; B41F 1/34; B41J 45/00

(52) U.S. Cl. ..... 101/216; 101/76; 101/175; 101/218; 101/480

(58) Field of Search ..... 101/480, 216, 101/175, 218, 76

(56) References Cited

U.S. PATENT DOCUMENTS

| | | | | | |
|---|---|---|---|---|---|
| 2,479,023 | A | | 8/1949 | Peyrebrune et al. | |
| 4,084,501 | A | * | 4/1978 | Kerwin et al. | 101/76 |
| 4,111,120 | A | * | 9/1978 | Paulson | 101/175 |
| 4,404,740 | A | * | 9/1983 | Hagg et al. | 29/606 |
| 5,103,732 | A | * | 4/1992 | Wells et al. | 101/480 |
| 5,727,465 | A | | 3/1998 | Kelm et al. | 101/216 |
| 5,784,964 | A | * | 7/1998 | Rodi | 101/480 |
| 5,868,071 | A | * | 2/1999 | Niemiro et al. | 101/218 |
| 5,960,714 | A | | 10/1999 | Gottling et al. | 101/216 |
| 6,038,972 | A | * | 3/2000 | Delwiche et al. | 101/216 |

FOREIGN PATENT DOCUMENTS

| | | |
|---|---|---|
| CH | 268 554 | 9/1950 |
| DE | 43 26 387 | 2/1995 |
| DE | 93 16 475 | 4/1995 |

* cited by examiner

*Primary Examiner*—Andrew H. Hirshfeld
*Assistant Examiner*—Marvin P. Crenshaw
(74) *Attorney, Agent, or Firm*—Cohen, Pontani, Lieberman & Pavane

(57) ABSTRACT

In order to provide a stand of a printing unit of a rotary printing machine, said stand being capable of being produced cost-effectively and having high inherent rigidity, a left-hand and a right-hand side wall are placed onto a bottom plate and screwed to the latter and are also provided with a cover plate, the cover plate resting with first locating faces on the side walls and with second locating faces against the side walls, the cover plate being screwed to the side walls at all the locating faces.

8 Claims, 3 Drawing Sheets

STAND OF PRINTING UNIT

BACKGROUND OF THE INVENTION

1. Field of the Invention

The invention relates to a stand of a printing unit of a rotary printing machine, said stand containing a left-hand and right-hand side wall.

2. Description of the Related Art

The specialized article by Schmidt, F. J. and Naumann, M.: Zur Konstruktion von Verarbeitungsmaschinen~Gestellen [On the Construction of Processing Machine Stands], in: Konstruktion 48 (1996) 128–136, Springer-Verlag 1996, pages 128 to 136, shows processing machine stands. These have two side walls, between which a baseplate and a plurality of crossmembers are arranged.

A stand of this type is cost-intensive because of complicated mechanical machining and a relatively large number of crossmembers. An increased outlay in terms of assembly also contributes to the rise in costs. Thus, round crossmembers are inserted into the side walls, in order to orient the bores of the side walls in alignment. All these crossmembers restrict the space available between the side walls for installing the functional groups of the processing machine, for example printing-unit cylinders, inking units, dampening units or image transfer devices in the case of printing machines.

For the transport of printing units, in order to increase the rigidity, additional crossmembers are inserted between the side walls and plates connecting the side walls at the front are screwed on. At the place of installation, the printing unit is placed onto a sturdy bottom plate and screwed down. Only then can the additional crossmembers be removed.

SUMMARY OF THE INVENTION

The object of the invention is to provide a printing-unit stand which can be produced cost-effectively and has high inherent rigidity.

The said object is achieved by providing a stand having left and right side walls, a base of each of the side walls being supported on a bottom plate, the side walls being affixed to the bottom plate. A cover plate is set on top of the side walls and connects them the cover plate being affixed to the side walls. By virtue of the cover plate connecting the side walls, a stand of the self-supporting gantry type is provided. This consists of only four structural parts, since any crossmembers may be dispensed with on account of the high inherent rigidity. The entire space between the side walls is thereby available for arranging the functional units of the printing unit.

The cover plate screwed to the side walls via locating faces contributes to the high rigidity. The locating faces, which constitute relatively small precision-machined screw-on faces, also contribute to efficient manufacture. Furthermore, by virtue of the locating faces, particularly simple and rapid assembly is possible. The side walls are oriented on the cover plate and spaced from one another. The cover plate can also compensate elastically some differences in height of the side walls, thus making it unnecessary for the side walls to be simultaneously machined in pairs in order to produce the base and cover surfaces.

The high inherent rigidity of the stand makes it possible to transport the latter, received on four eye bolts secured, for example, in passage structure of the stand, without additional crossmembers, carrying frames or other reinforcements being provided.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
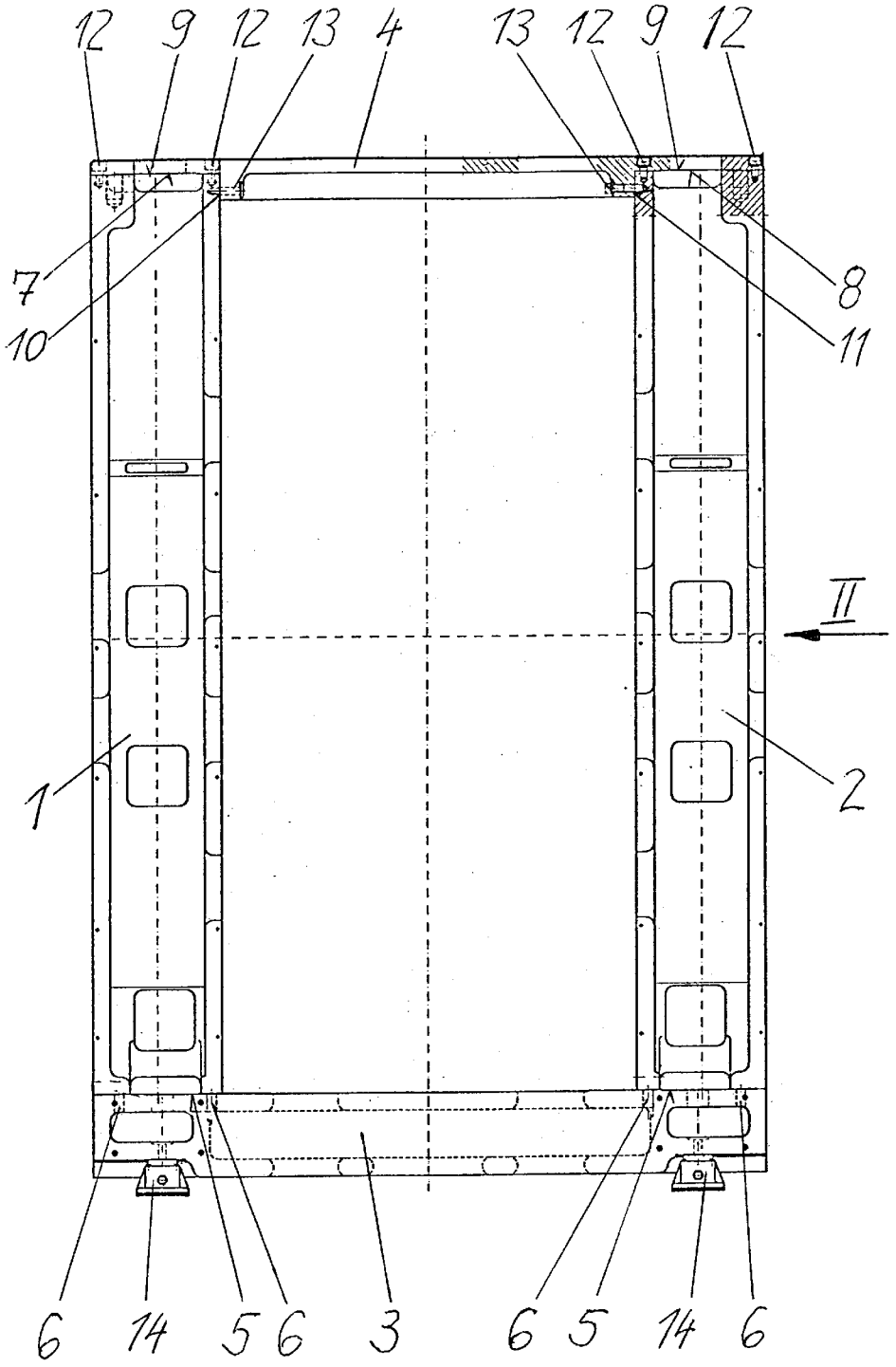
FIG. 1 is a front view of a stand of a printing unit.
Figure 2:
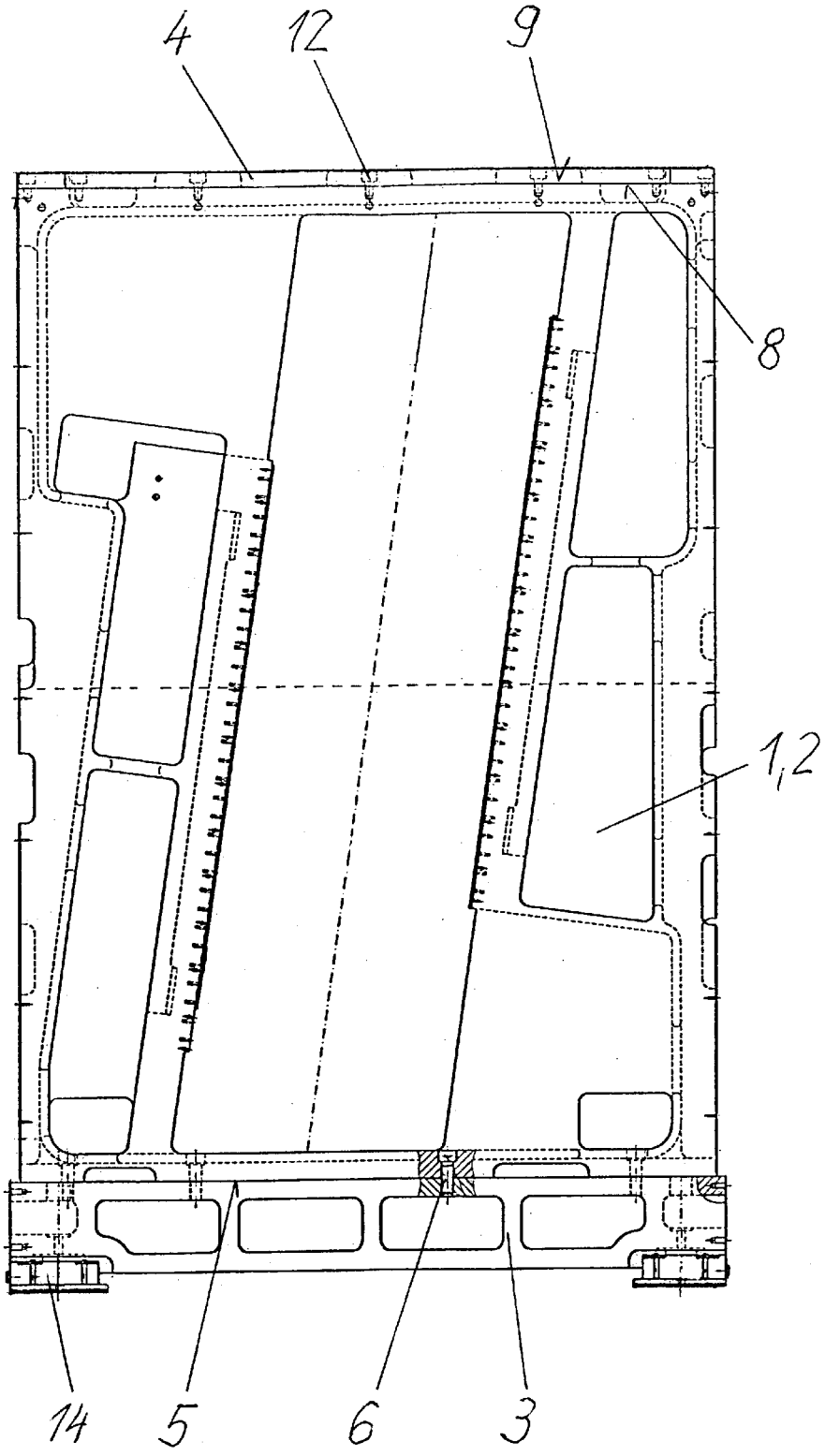
FIG. 2 is a side view looking in the direction of arrow II FIG. 1.

The stand, illustrated in FIGS. 1 and 2, of a printing unit of a rotary printing machine contains spaced apart left-hand and right-hand side walls 1, 2, a bottom plate 3 and a cover plate 4. The left-hand and right-hand side walls 1, 2 are each placed with a base surface 5 onto the bottom plate 3 and screwed to the latter. The screws 6 used for this purpose are arranged in the edge regions of the base surfaces 5, with the result that a high rigidity of the screw connection of the side walls 1, 2 to the base plate 3 is achieved.

The cover plate 4 lies with a left-hand first locating face 7 on the left-hand side wall 1 and with a right-hand first locating face 8 on the right-hand side wall 2, in each case on a cover surface 9 on top of a respective side wall 2, 3. Furthermore, the cover plate 4 has a left-hand second locating face 10 and an oppositely facing right-hand second locating face 11 abutting against mutually facing lateral surfaces of the respective side walls 1, 2 and is screwed to the respective side walls 1, 2 at all the locating faces 7, 8, 10, 11 by means of screws 12, 13. In this case, the screws 12 are arranged on the left-hand and right-hand first locating faces 7, 8 in the edge regions of the latter, thus resulting in a particularly rigid connection of these locating faces 7, 8 to the side walls 1, 2.

During assembly, first the side walls 1, 2 are firmly connected to the cover plate 4 by the screws 12, 13 being tightened, the side walls 1, 2 being oriented at the cover plate 4 and being spaced from one another. Only thereafter are the side walls 1, 2 screwed to the bottom plate 3.

The bottom plate 3 is supported on commercially available vertically adjustable feet 14. The stand is placed with these feet 14 onto a working area surface such as the floor of a workshop. The stand can be oriented in two planes and with respect to adjacent stands by means of the feet 14.

Figure 3:
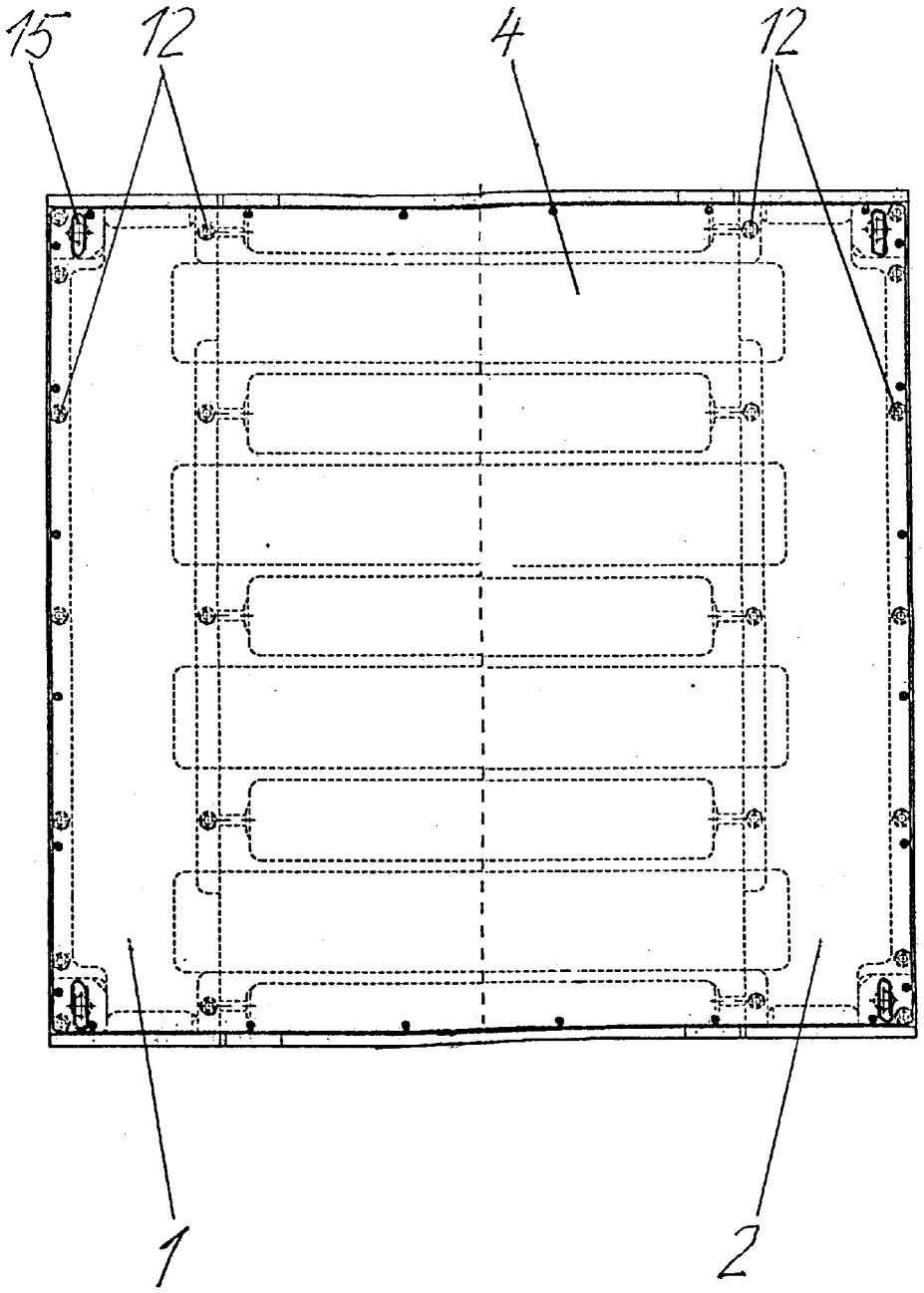
FIG. 3 is a top view of the stand.

Four eye bolts 15 inserted through passage holes of the cover plate 4 can be screwed into the stand, more precisely into the left-hand and right-hand side walls 1, 2, by means of which eye bolts the stand, suspended on a lifting appliance, can be transported. The eye bolts 15 are depicted only in FIG. 3.

The base surfaces 5, the cover surfaces 9 and the locating faces 7, 8, 10, 11 may be continuously machined or else interrupted faces, for example interrupted by lower-lying cast faces. The bottom plate 3 also needs to be machined only in the region of the left-hand and right-hand side walls 1, 2.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A printing unit of a rotary printing machine, the printing unit comprising a stand, the stand comprising:

a bottom plate;

spaced apart left-hand and right-hand side walls, said walls having base surfaces, said base surfaces being received on said bottom plate, said walls being affixed to said bottom plate; and a cover plate, said plate having a left-hand first locating face and a right-hand first locating face thereon, said cover plate being received on said left-hand and right-hand walls with said left-hand and right-hand first locating faces received on top of said left-hand wall and said right-hand wall, respectively, said cover plate further having a left-hand second locating face and a right-hand second locating face, said left-hand and right-hand second locating faces being oppositely facing and abutting against mutually facing lateral surfaces on said left-hand and said right-hand walls, respectively, said walls being affixed to said cover plate at each of said first and second locating faces.

2. A printing unit according to claim 1, wherein said walls are affixed to said cover plate and to said bottom plate with screws.

3. A printing unit according to claim 2, wherein the screws for screwing the walls to the bottom plate are arranged in edge regions of the wall base surfaces.

4. A printing unit according to claim 2, wherein the screws for screwing the walls to the cover plate are arranged in edge regions of each of the respective left-hand and right-hand first locating faces.

5. A printing unit according to claim 1, comprising passages in the stand for receiving eye bolts for lifting the stand, the eye bolts being screwed into said passages.

6. A printing unit according to claim 5, wherein the passages are in each of the left-hand and right-hand side walls.

7. A printing unit according to claim 1, comprising vertically adjustable support feet carried on said bottom plate for supporting said stand on a working area surface.

8. A printing unit according to claim 1 wherein said left-hand and right-hand first locating faces extend over the entire length of respective left-hand and right-hand side walls.

* * * * *